US010196854B2

(12) United States Patent
Kross

(10) Patent No.: US 10,196,854 B2
(45) Date of Patent: Feb. 5, 2019

(54) DOOR SEAL WITH TWO SEALING PLANES

(71) Applicant: Planet GDZ AG, Tagelswangen (CH)

(72) Inventor: Manfred Kross, Iserlohn (DE)

(73) Assignee: PLANET GDZ AG, Tagelswangen (CH)

( * ) Notice: Subject to any disclaimer, the term of this patent is extended or adjusted under 35 U.S.C. 154(b) by 155 days.

(21) Appl. No.: 14/423,236

(22) PCT Filed: Aug. 23, 2013

(86) PCT No.: PCT/EP2013/067556

§ 371 (c)(1),
(2) Date: Feb. 23, 2015

(87) PCT Pub. No.: WO2014/029877

PCT Pub. Date: Feb. 27, 2014

(65) Prior Publication Data

US 2015/0240555 A1 Aug. 27, 2015

(30) Foreign Application Priority Data

Aug. 23, 2012 (DE) ..... 20 2012 008 018 U

(51) Int. Cl.
*E06B 7/18* (2006.01)
*E06B 7/21* (2006.01)
*E06B 7/23* (2006.01)

(52) U.S. Cl.
CPC ..... *E06B 7/18* (2013.01); *E06B 7/21* (2013.01); *E06B 7/2305* (2013.01)

(58) Field of Classification Search
CPC ..... E06B 1/70; E06B 7/18; E06B 7/26; E06B 7/2305; E06B 7/20; E06B 7/21
(Continued)

(56) References Cited

U.S. PATENT DOCUMENTS 97,362 A * 11/1869 Cretors ..... E06B 7/20 49/308
649,150 A * 5/1900 Winter ..... E06B 7/20 49/308

(Continued)

FOREIGN PATENT DOCUMENTS

DE 1181389 A 11/1964
DE 2352873 A1 4/1975

(Continued)

*Primary Examiner* — Catherine A Kelly
(74) *Attorney, Agent, or Firm* — Browdy and Neimark, PLLC

(57) ABSTRACT

The door seal comprises a fixing element (20) for fixing to a door, a seal receiving element (40), a lowering mechanical unit (20) for lifting and lowering the seal receiving element (40) relative to the fixing element (20), and a sealing element (50) fixed to the seal receiving element (40). The sealing element (50) provides a first sealing line (54*a*) by means of a first sealing element portion (54) which can be lifted or lowered by means of the lowering mechanical unit, and the first sealing element portion (54) is a sealing lip and/or a sealing arc. The sealing element (50) provides a second sealing line (55*a*) by means of a second sealing element portion (55), said second sealing line running parallel to the first sealing line (54*a*). The second sealing element portion (55) has a first and a second side (52, 56), said first side (52) can be lifted and lowered by means of the lowering mechanical unit and said second side (56) is fixed in its position relative to the fixing element (20). In the lowered state, the first and the second sealing line (54*a*, 55*a*) seal against a surface which can be found outside of the door seal. Said seal allows a sufficient sealing of the gap between frames and doors when the seal is lowered even during a horizontal movement.

28 Claims, 6 Drawing Sheets

(58) Field of Classification Search
USPC ..... 49/470, 303, 306, 307, 308, 313, 314
See application file for complete search history.

(56) References Cited

U.S. PATENT DOCUMENTS 1,009,879 A * 11/1911 Ackerman ..... E06B 7/18 49/319
1,494,110 A * 5/1924 Hagstrom ..... E06B 7/18 49/310
1,781,864 A * 11/1930 Wyatt ..... E06B 7/20 49/308
1,973,210 A * 9/1934 Hufnail ..... E06B 7/18 49/480.1
2,575,459 A * 11/1951 Moten ..... E06B 7/20 49/308
2,765,504 A * 10/1956 Laumann ..... E06B 7/18 292/36
2,766,860 A * 10/1956 Travis ..... E06B 7/18 49/318
3,252,255 A * 5/1966 Marpe ..... E06B 7/18 49/318
3,374,580 A * 3/1968 Ruff ..... E06B 7/2316 49/470
3,418,753 A * 12/1968 Hanson ..... E06B 7/20 49/308
3,448,543 A * 6/1969 Multer ..... E06B 7/2312 49/470
3,453,780 A * 7/1969 Thompson ..... E06B 7/18 49/482.1
3,504,456 A * 4/1970 Frederick, Jr. ..... E06B 7/16 49/470
3,706,162 A * 12/1972 Werner ..... E06B 7/20 49/310
3,871,133 A * 3/1975 Ellingson, Jr. ..... E06B 7/20 49/308
4,425,738 A * 1/1984 Christensen ..... E06B 7/215 49/308
4,497,136 A * 2/1985 Khallil ..... E06B 7/16 49/480.1
4,519,165 A * 5/1985 Cronenberg ..... E06B 7/215 49/306
4,703,586 A * 11/1987 Smith ..... E06B 7/20 49/303
4,852,302 A * 8/1989 Berniola Gil ..... E06B 7/215 49/303
4,947,584 A * 8/1990 Wexler ..... E06B 7/215 49/307
5,642,588 A * 7/1997 Sowers ..... E06B 7/215 49/307
6,082,047 A * 7/2000 Comaglio ..... E06B 7/215 49/303
6,105,313 A * 8/2000 Holloway ..... E06B 7/18 49/318
6,195,939 B1 * 3/2001 Sowers ..... E06B 7/21 49/307
6,973,753 B2 * 12/2005 Liebscher ..... E06B 3/5072 49/141
8,745,924 B2 * 6/2014 Tshai ..... E06B 7/215 49/303
8,925,250 B2 * 1/2015 Parker ..... E06B 7/21 49/306
2007/0022663 A1 * 2/2007 Faflek ..... E05C 19/16 49/306

FOREIGN PATENT DOCUMENTS

DE 2848746 A1 5/1980
DE 3012660 A1 10/1981
DE 3012660 C2 9/1985
DE 202007003328 U1 5/2007
EP 1122394 A2 8/2001
EP 1162341 A1 12/2001
EP 1460232 A1 9/2004
EP 1460232 B1 8/2006
EP 1905938 A2 4/2008

* cited by examiner

DOOR SEAL WITH TWO SEALING PLANES

TECHNICAL FIELD

The invention relates to a door seal, in particular to a door bottom seal. The door seal comprises a fastening element for fastening to the door, a seal receiving element, a lowering mechanism unit which mechanically couples the fastening element to the seal receiving element and which is designed in order to lower the seal receiving element from a raised position into a lowered position and conversely to raise same from the lowered position to the raised position, and a sealing element which is fastened to the seal receiving element and extends in a longitudinal direction.

PRIOR ART

A door seal, in particular door bottom seals, of such a design are used in order to seal doors along the lower edge thereof in relation to the floor in an airtight and sound-tight manner. By means of such a door seal, sound insulation can be achieved and fire protection regulations met by avoiding the passage of air and smoke. A door bottom seal is referred to below even if the seal is intended to seal the upper gap of the door and ceiling or upper side of the door frame. In the following, the term "door bottom seal" therefore also includes door seals which do not seal against the floor but rather against the ceiling.

An essential feature of such door bottom seals is the lowering mechanism thereof which causes the seal to be raised over the largest portion of movement during the opening and closing of the door and, by this means, the seal does not rub on the floor. Only within a movement range shortly before the closed position is reached and shortly after the closed position is left is the seal lowered and pressed against the floor, or raised, respectively. This movement is brought about by a lowering mechanism which is actuated, for example, by means of an actuating lever or button or the like arranged on the side edge of the door, and a corresponding transmission mechanism by the button being pressed in shortly before the closed position is reached and being pushed out in a spring-actuated manner shortly after the closed position is left, respectively. For this purpose, for example in the case of doors mounted pivotably, the button can be arranged on the hinge side and, in the case of sliding doors, can be correspondingly placed on the lock side. A door bottom seal of such a design is known from EP1162341B1 and EP1460232B1.

In principle, with this design of door bottom seals, reliable sealing over a long period of use of doors can be achieved in the case of a floor without a sill or else in the case when a door sill is used. However, there is still a need for improvement in the case of the existing door bottom seals in order to improve the functionality during use and in installation.

SUMMARY OF THE INVENTION

The first problem of the devices according to the prior art thus consists in that the lowering mechanism, in particular in the event of a long lowering distance of the door bottom seal, does not move the latter on an exactly vertical path, but instead a horizontal movement component in the longitudinal direction of the seal also occurs. This problem occurs in particular in the case of robust lowering mechanisms which are actuated by one or more pivot levers and in which linear guides having a correspondingly high degree of wear have preferably been omitted in a lowering mechanism for longevity purposes. However, this horizontal movement component may result in air gaps laterally next to the seal, which impair the sealing effect over the entire floor gap. However, seals which are actuated via leaf springs or seals with little lateral displacement, if any at all, also have the problem that the gap between door and frame cannot be sufficiently sealed. It is a first object of the invention to provide a door bottom seal which overcomes this disadvantage.

A further problem consists in that, for soundproof insulation with a high degree of noise insulation, the door bottom seal has to be functionally joined into the entire sealing system of a door. In the case of known door bottom seals, this is possible only by numerous individual seals being arranged on the frame, the seals effectively sealing against the door and thereby closing gaps which arise. However, these seals, which are mounted on the frame or the door, for providing a seal between door and frame are frequently subject to wear, can be complicated to adjust during installation and are sensitive to misalignments. It is a second object of the invention to provide a door bottom seal which can be incorporated in a functionally better manner into the entire sealing system of a door and simplifies the installation.

It is furthermore also desirable for a door bottom seal to seal both reliably against smooth floors, but at the same time also to achieve this sealing effect in the event of unevenness and floor soiling.

Finally, a further functionality, which is capable of improvement, on existing door bottom seals can be identified. This consists in the door bottom seal typically being used in a groove milled into the lower edge of the door and being intended to prevent the passage of sound, smoke and air through the floor clearance gap under the door. In addition to reliable sealing of the door bottom seal against the floor, it is also required for this purpose for the air and sound travel to be prevented by the sealing construction itself or by the groove. However, a problem in this connection is that, firstly, both during the lowering operation and the raising operation of the seal, as little friction as possible between the parts moving relative to one another is desirable in order to achieve smooth-running and to reduce wear. By contrast, in the lowered sealing position, an entirely sealed structure of the entire door bottom seal is desirable, which, in turn, requires a fixed system of the individual structural elements for sealing the structural gaps of the door bottom seal. In particular, these functions, i.e. the easy movability and the reliable sealing in the lowered state, are intended to be maintained even if the door or groove is geometrically warped as a consequence of moisture, the effects of heat or the like and thereby deviates from the ideal rectilinear geometry.

The door seal according to the invention comprises

- a fastening element for fastening to the door,
- a seal receiving element,
- a lowering mechanism unit which mechanically couples the fastening element to the seal receiving element and which is designed in order to lower the seal receiving element from a raised position into a lowered position and conversely to raise same from the lowered position to the raised position, and
- a sealing element which is fastened to the seal receiving element and extends in a longitudinal direction. According to the invention, the sealing element provides a first sealing line by means of a first sealing element portion, which is lowerable and raisable by means of the lowering mechanism unit, respectively, and provides a second sealing line running parallel to the first sealing line by means of a second sealing element section with a first side and a second side, the first side of which is lowerable by means of the lowering mechanism and the second side of which is fixed in the position in relation to the fastening element. The two sealing lines seal against a surface located outside the door seal. According to the invention, the first sealing element portion is not a rolling seal, but rather is preferably a sealing lip and/or a sealing arc, wherein the sealing arc extends from a first arc end to a second arc end, and wherein the two arc ends are lowerable and raisable relative to the fastening element together with the seal receiving element.

The sealing element comprises a recess, the recess defining a region of the sealing element being thinner than regions of the sealing element bordering on the recess, the recess being arranged on the first side of the second sealing element and the recess separating the second sealing element portion from the first sealing element portion.

The sealing arc can be designed, for example, in accordance with EP 1 122 394. The sealing lip can be designed as explained below or as per EP 1 905 938.

The two sealing lines can seal a single common surface or different surfaces; that is to say, the first sealing line can seal against the floor or the ceiling and the second sealing line can seal against the lateral frame of the door.

The second sealing element portion is preferably formed by a sealing leg arc, in particular of a rolling seal.

In preferred embodiments, the door seal according to the invention uses the advantages of a first sealing element portion, which is fastened exclusively in the seal receiving element and which therefore moves together with the latter with respect to the fastening element, with a second sealing element portion in the form of a rolling seal.

In a preferred embodiment, the first sealing element portion is preferably lowerable and raisable with a full lowering stroke of the lowering mechanism unit, wherein the lowering stroke defines a height, and wherein, in the raised state, the second side of the second sealing element portion is mounted along this distance at a lower height than the first sealing element portion.

Essentially all known mechanisms which automatically lower the sealing strip in particular when the door is closed and automatically raise said sealing strip again when the door is opened can be used as a lowering mechanism. The mechanism is preferably spring-loaded. For example, it has leaf springs which extend in the longitudinal direction of the seal and are fastened by one end to an actuating rod, at another end to the housing of the seal and are fastened here by a central region to the raisable and lowerable sealing strip carrying the sealing element. The actuating rod can be displaced in the longitudinal direction of the seal by means of an actuating button protruding beyond the seal housing on one side. In particular in the case of a flat bar, the actuating rod is also called a slider. In this text, a sliding block acting as actuating rod is mentioned as an example. In this text, the housing is also referred to as a fastening element, and the carrier strip or sealing strip as seal receiving element.

The second sealing element portion is preferably raisable and lowerable by means of the lowering mechanism with a fraction, in particular half, of the lowering stroke of the lowering mechanism unit.

In a preferred embodiment, the second side of the second sealing element portion is arranged offset laterally transversely with respect to the longitudinal direction for the fastening of the first sealing element portion.

The two sealing element portions can be designed as portions which are separate from each other. However, they are preferably connected to each other. They are preferably designed jointly as a single piece. The entire sealing element is preferably designed as a single piece.

The abovementioned objects are achieved, according to a first aspect of the invention, by a door bottom seal of the design mentioned at the beginning by the sealing element providing a first sealing line by means of a first sealing element portion, which is lowered and raised by means of the lowering mechanism unit with a full lowering stroke of the lowering mechanism unit, and providing a second sealing line, which runs parallel to the first sealing line, by means of a second sealing element portion, which is formed by a sealing leg arc, the one side of which is lowered by means of the lowering mechanism and the other side of which is fixed in position in relation to the fastening element, wherein the second sealing element portion is lowered and raised by means of the lowering mechanism with a fraction, in particular half, of the lowering stroke of the lowering mechanism unit.

The invention provides a door bottom seal which is distinguished by two sealing lines which are spaced apart from each other when the door bottom seal is lowered and seals against the floor/the sill. The two sealing lines are acted upon in a kinematically different manner to the effect that the first sealing line is moved with the full stroke of the upward or downward movement of the lowering mechanism unit whereas the second sealing line is formed on a sealing leg arc which is moved on one side with the full stroke, but is fixed on the other cross-sectional side with respect to the fastening element or the door. By means of this one-sided movement of the arc, the second sealing line typically moves with half the movement stroke. By means of this design, the door bottom seal according to the invention permits a double and different sealing effect which is superior to types of seal with two sealing lines of conventional design. It is thus possible according to the invention to provide a sealing effect, which is obtainable over a wide stroke range, in order to compensate for unevenness and at the same time to achieve a sealing effect with high contact pressure over a shorter stroke range. In the customarily achieved installation window with a floor clearance of approximately 7 mm, the seal according to the invention thereby obtains an ideal sealing effect which is also insensitive to soiling and floor distortions or other unevennesses. However, at the same time, a large tolerance in relation to installation inaccuracies with deviations from the ideal floor clearance size upward or downward can also be achieved with the seal according to the invention.

In particular, the floor seal according to the invention can also be designed in such a manner that the first sealing line is formed on a seal portion which is formed from a different material than a seal portion on which the second sealing line is formed. For example, it is advantageous to form the first sealing line, which moves with a large stroke, on a seal portion which has a predetermined, preferably high, degree of elasticity and deformability, and to form the second sealing line on a seal portion which has a lower degree of elasticity and greater rigidity by comparison. As an alternative or in addition to a difference of material, the differing elasticity of the seal in the region of the first and second sealing line can also be achieved by corresponding geometrical configurations of the seal, wall thicknesses of the seal or the like. It is crucial for the effect according to the invention that the first sealing line is designed in such a manner that it exerts a smaller elastic counterforce in relation to a force acting in the direction of movement of the seal than the seal in the region of the second sealing line does.

A second advantageous aspect of the door bottom seal according to the invention is that the second sealing line is not fastened at the one leg end thereof to the movable structural element of the door bottom seal, but instead can be fastened independently of the lowering mechanism. This makes it possible to fasten said second end of the sealing leg arc, for example, directly in the border region of the lower door edge or to the fastening element and thereby to offset the second sealing line into the plane of the seal stop plane between door and door frame or to arrange said sealing line at least directly adjacent to said seal stop plane between door frame and door. By this means, the disadvantage of known door bottom seals which have an offset of the sealing line of the door bottom seal with respect to the seal stop plane between door frame and door of 10 mm and more is overcome and the resulting air gap which forms in each case at the sides of the door both on the hinge side and on the lock side of the door is avoided or at least decisively reduced. Finally, a further advantageous aspect of the door bottom seal according to the invention is that, by the one-sided fixing of the sealing leg arc and the fastening, which is formed on the other side, of the sealing leg arc to the lowering mechanism, it is possible to exert a horizontally acting transverse force, which acts perpendicularly to the longitudinal axis of the seal, on the seal when the second sealing line strikes against the floor or the sill. This transverse force can bring about an advantageous press-on force perpendicularly to the longitudinal axis within the door bottom seal between seal and lowering mechanism or seal receiving element or fastening element, as a result of which the sealing effect against sound, draught and the like passing through the door bottom seal itself is considerable increased. It is advantageous here that this increase in the sealing effect is obtained only when the second sealing line strikes against the floor, and therefore the smooth-running of the lowering movement and raising movement is not impaired as a result.

The first and second sealing lines preferably run parallel and at a distance from each other. They preferably extend over the entire length of the seal, but the scope of the invention also includes variants in which one or both sealing lines are interrupted in places, in particular also when this could be caused by unevennesses of the floor. The sealing leg arc is in particular arched convexly outward when the seal is lowered, wherein this arching changes by contact with the floor, for example can be compressed and can arch back inward into a concave shape.

The sealing element itself can be of single-part or of two-part design. A single-part embodiment which can be formed by means of coextrusion or other manufacturing methods and also in the form of a single-part seal made from two different materials is preferred. Alternatively, the sealing element can be assembled from two or more elements which in each case extend completely over the entire length of the seal or which adjoin each other in the longitudinal direction. This plurality of elements which form the sealing element can be connected to one another, for example adhesively bonded, or preassembled in some other manner, and said elements can likewise also only be assembled to form the sealing element during the installation of the seal.

The lowering mechanism can comprise in particular a plurality of mechanical parts, such as levers, rails, actuating buttons and the like which, in particular, convert the closing movement of the door in interaction with the frame into a vertical lowering movement and, conversely, convert the opening movement of the door into a vertical upward movement of the sealing element.

The lowering mechanism unit here can be designed in particular according to the prior art, as described in the European patent referred to above. In particular, the lowering mechanism unit can be designed in such a manner that it executes a substantially vertical movement component with a small horizontal movement component superimposed thereon in the longitudinal direction of the sealing element.

According to a first preferred embodiment or, alternatively, a further aspect of the invention, it is preferred, for an abovementioned door bottom seal according to the invention or door bottom seal explained at the beginning, that the sealing element is mounted in a freely displaceable manner in the longitudinal direction relative to the fastening element, and preferably is mounted in a freely displaceable manner on the seal receiving element. The advantage afforded by this development is that the seal does not inevitably have to follow a horizontal movement component which acts on the seal by means of the lowering mechanism. Instead, by means of the free displaceability of the seal, a relative movement can take place, and therefore the seal remains in a horizontally fixed position and consequently executes a purely vertical movement component. By this means, it is firstly possible, despite the use of a lowering mechanism with a horizontal movement component, to extend the sealing element over the entire width of the door without having to provide play here for the horizontal movement component of the lowering mechanism. In particular, the effect which can be achieved with this development is that the seal, because of its adhesion to the floor, does not execute any relative displacement with respect to the fastening element and therefore to the door during the lowering operation in order thereby to compensate for the horizontal movement component and to remain horizontally fixed in position. This displaceability can also be used without a second sealing line.

It is particularly preferred here if the lowering mechanism unit moves the seal receiving element relative to the fastening element between a raised and a lowered position on a movement path which contains a vertical movement component and a horizontal movement component running in the longitudinal direction of the sealing element, and that the sealing element is fastened in a fixed manner with respect to the fastening element in the longitudinal direction and so as to be movable relative to the seal receiving element in the longitudinal direction of the sealing element. By means of the relative moveability, which is provided by this development, of the sealing element with respect to the seal receiving element, on the one hand, and fixed position of the sealing element with respect to the fastening element, on the other hand, first of all compensation of the horizontal movement components of the lowering mechanism is made possible and, at the same time, exact positioning of the sealing element and maintaining of this positioning with respect to the fastening element or the door, on which the fastening element is mounted, is achieved. The door bottom seal is therefore designed in such a manner that the sealing element is fixed in a fixed position with respect to a horizontal direction along the extent of the sealing element, but at the same time can execute the vertical lowering movement and can compensate here for a horizontal movement component by means of relative moveability with respect to the lowering mechanism unit. In another definition, this function is achieved by the sealing element being fastened by means of two fastening portions, of which one fastening portion has a relative displaceability in the longitudinal direction of the sealing element relative to the fastening element and the other fastening portion fixes the sealing element horizontally in the longitudinal direction of the sealing element.

According to a further preferred embodiment, it is provided that the sealing element has a first fastening portion for fastening to the seal receiving element and a second fastening portion, which is spaced apart from the first fastening portion, for fastening the sealing element to the door or to the fastening element. In this embodiment, the sealing element is connected to the door or to the fastening element at two regions spaced apart from each other and is of corresponding design for this purpose. The first fastening portion, which can extend in particular along the entire length of the sealing element, is fastened to the seal receiving element and is therefore moved directly by the lowering mechanism unit. In this case, the previously described, preferred relative displaceability in the longitudinal direction of the sealing element can be provided between said first fastening portion and the seal receiving element, alternatively said relative moveability can also be provided between the seal receiving element and the lowering mechanism unit or the lowering mechanism unit and the fastening element. The second fastening portion is spaced apart from the first fastening portion and can preferably extend parallel thereto. The second fastening portion can also preferably be formed along the entire length of the sealing element. However, it may also be present, for example, only in the two border regions of the seal. It makes it possible to fasten the sealing element to the door or to the fastening element in a fixed position in order thereby to achieve the effect that the sealing element is immovable in the horizontal direction along the sealing element with respect to the door. For this purpose, the second fastening portion can firstly be designed to be fastened directly to the door or to the fastening element, for example by being clipped into a corresponding groove or being adhesively bonded to the door. The second fastening portion can be fastened in a form-fitting, frictional or integrally bonded manner or by means of a combination thereof. Alternatively, the second fastening portion can also be fastened directly to the fastening element which, for its part, is fastenable in a positionally fixed manner to the door or to the fastening element and is designed for this purpose. The associated second sealing element portion can likewise extend over the entire length of the seal. However, it can also be present only in the two border regions of the seal, wherein, also in this case, the second fastening portion extends either over the entire length of the seal or only over the border region. Alternatively, it is also possible for the second fastening portion and/or the second sealing element portion to extend in some sections over the entire length of the seal, i.e. not to be present in intermediate regions of the seal.

It is furthermore preferred that the first fastening portion is fastened to the seal receiving element, and the second sealing line is arranged mechanically between the first and the second fastening portion. The effect achieved by this further development is that the second sealing line is formed in a region of the sealing element that is coupled moveably on one side to the lowering mechanism unit and is fixed on the other side in a positionally fixed manner with respect to the door by means of the second fastening portion. The effect achieved by this is that, when the lowering mechanism unit is actuated, the second sealing line does not move with the full vertical stroke of the lowering mechanism unit, but instead moves with a smaller movement extent, a fraction of this stroke, and in particular, the second sealing line when arranged approximately centrally between the two fastening points on the seal receiving element, on the one hand, and the second fastening portion, on the other hand, can move with half the stroke of the lowering mechanism unit.

It is preferred even further that the first fastening portion is displaceable relative to the fastening element and the second fastening portion is designed for positionally fixed fastening to the door or to the fastening element. By means of this relative displaceability between the first fastening portion and the door, the possibility is provided of compensating for a horizontal movement component of the lowering mechanism unit in such a manner that the sealing element remains horizontally fixed in position and lowers and rises on a pure vertical movement path. The positionally fixed fastening of the second fastening portion can in turn take place directly to the door or to the fastening element of the door bottom seal.

It is preferred even further that the fastening element, the seal receiving element, the first sealing element portion, the second sealing element portion, the first fastening portion and/or the second fastening portion extend over the entire length of the sealing element. By means of this embodiment, reliable sealing and functioning of the door bottom seal over the entire width of the door is made possible without undesirable air gaps here permitting the passage of sound, air, smoke or the like.

According to a further preferred embodiment, it is provided that the first fastening portion extends parallel and over the same length as the second fastening portion and/or the first sealing element portion extends parallel and over the same length as the second sealing element portion. The parallel and identically long configuration of the fastening portions and the sealing element portions permits, in particular, cost-effective manufacturing and, furthermore, makes it easier to install the door bottom seal according to the invention.

It is preferred even further that the second sealing line is formed on an arc portion which is arched convexly outward and preferably, at one arc end, has a first fastening region for positionally fixed fastening of the sealing element to the door or to the fastening element, and, at another arc end, has a second fastening region for the vertically movable fastening relative to the fastening element. The effect achieved by this embodiment is that, on contact of the second sealing line with the floor or a sill, a vertical sealing force and a horizontal transverse force perpendicularly to the longitudinal direction of the sealing element are exerted on the sealing element, as a result of which the sealing element is pressed onto the seal receiving element and also, by formation of corresponding sealing legs, could be pressed onto the fastening element and/or parts of the lowering mechanism unit. This pressing-on operation achieves effective sealing which effectively prevents the passage of sound and air by means of the door bottom seal itself, with the first and second sealing lines being bypassed. In addition, by the exerting of the horizontal transverse force only upon contact of the second sealing line with the floor, the increased friction between the sealing element and parts of the door bottom seal is prevented from resulting in a deterioration in the smooth running of the lowering movement and raising movement.

It is further preferred that the sealing element has a first fastening region for positionally fixed fastening of the sealing element to the door or to the fastening element, and a second fastening region for the vertically movable fastening relative to the fastening element, and that a frame sealing portion of the sealing element extends from the second fastening region beyond the first fastening region for positioning in the door leaf plane and sealing against the door frame. With this development, sealing against the door frame is achieved by the bottom seal, and therefore, despite an offset of the sealing lines of the door bottom seal, the sealing effect against the floor is complete in the entire system of the seal against the frame and door. The frame sealing portion preferably extends over the entire length of the sealing element in order to realize advantages in terms of manufacturing and to provide a robust design. Alternatively, however, the frame sealing portion can also be formed only in one or both end regions where contact with the frame takes place.

A further aspect of the invention is a door leaf with a door bottom seal of the previously described design, in which the second sealing element portion reaches as far as the border of the lower edge of the door leaf, in particular in such a manner that the second sealing line is arranged adjacent to the border of the lower edge of the door leaf, and is preferably arranged at a distance of less than 10 mm, preferably less than 7.5 mm, from the border of the lower edge of the door leaf.

Such a door leaf with a door bottom seal according to the invention in the corresponding fitted position permits complete sealing in the lower region of the door in a particularly advantageous manner. This is made possible and is assisted by the fact that the second sealing line can be placed into the seal stop plane between door frame and door or can at least be arranged very close to said seal stop plane. The seal between door and door frame therefore runs both in the region of the door bottom seal and in the region of the seal stop plane of the door frame in a plane or in a narrow plane region, as a result of which sealing by bridging sealing elements which extend horizontally perpendicularly to the longitudinal extent of the sealing element is unnecessary or can be reduced to only short portions.

The second sealing element portion here can preferably be designed as a frame sealing portion and extends into the plane of the door leaf surface facing the frame, or extend beyond said plane. A door leaf which achieves complete sealing against door frame and floor in the region of the lower edge is thus provided.

A further aspect of the invention is a use of a door bottom seal of the previously described design with a first and second fastening portion for sealing the air gap between a door and a floor or a floor sill in such a manner that the second fastening portion is fastened in a border region of the lower edge of the door or to the fastening element. This specific use realizes the advantages of the above-described door leaf. To explain the function and advantages of this use, reference is made to the corresponding description above regarding the door leaf.

The use can be developed by a door bottom seal with an arc portion which is arched convexly outward being used, and part of the arc portion running in the border region of the lower edge of the door, preferably in alignment with the door leaf surface above the lower edge border region. With this development, the sealing element portion which forms the second sealing line is placed into a position advantageous for the entire seal, including the seal stop plane of the door frame, and easy installation of the door bottom seal with the aim of complete sealing and simplified adjustment is achieved.

BRIEF DESCRIPTION OF THE DRAWINGS

Preferred embodiments of the door bottom seal according to the invention are explained with reference to the attached figures, in which.

DESCRIPTION OF PREFERRED EXEMPLARY EMBODIMENTS

Figure 1:
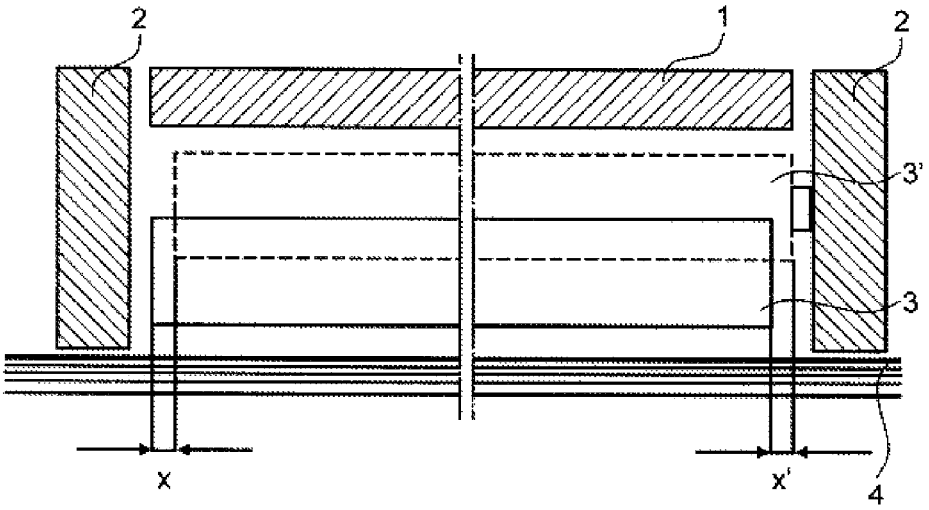
FIG. 1 (Prior Art)
FIG. 1 shows a schematic illustration of the functioning of a door bottom seal according to the prior art in a frontal view.
Figure 2:
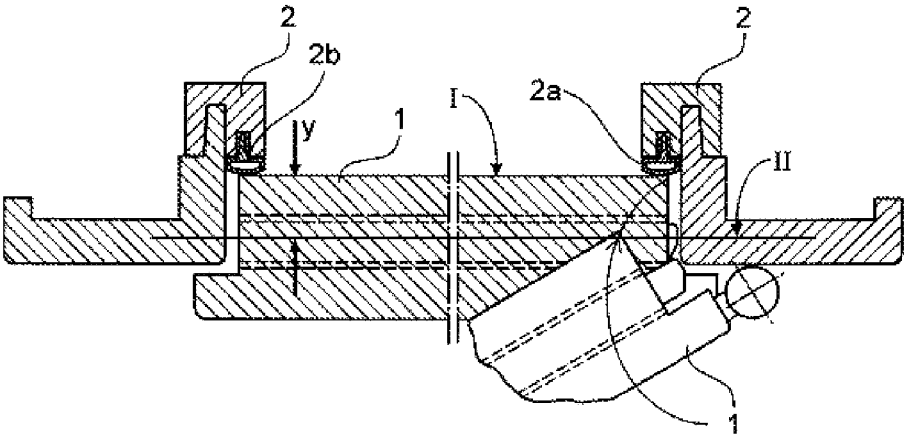
FIG. 2 (Prior Art)
FIG. 2 shows a schematic illustration of the functioning of a door bottom seal according to the prior art in a horizontally sectioned top view.

With reference first of all to FIGS. 1 and 2, two properties of prior art door bottom seals that are capable of improvement are shown. FIG. 1 shows a door bottom seal 3 which is mounted on a door 1 which, in turn, is mounted on a frame 2. The door bottom seal 3 is shown in a lowered position (continuous lines) 3 and a raised position (interrupted lines) 3'. As is seen in the comparison of the lowered position to the raised position, the seal moves with a vertical movement component which brings about the desired lowering operation in order to obtain the seal against the floor 4, but, in the process, also executes a horizontal movement, which is caused by the kinematics of the lowering mechanism, in the longitudinal direction of the door bottom seal. This horizontal movement component is identified by X or X' in FIG. 1 and results in an air gap X' on the right side (hinge side) which reduces the sound insulation properties and permits the passage of air, smoke and the like to a certain extent.

It is clear from FIG. 2 how the seal runs between door frame and door, on the one hand, and door with respect to the floor, on the other hand. As can be seen, the door 1 is attached to the frame 2 both on the hinge side (on the right in FIG. 2) and on the lock side (on the left in FIG. 2) in a plane which is defined by two rubber seals 2*a, b*. The rubber seals bring about a relatively soundproof stop which is sealed against the passage of air, smoke, etc. This sealing plane is identified by I in FIG. 2.

In contrast, the door bottom seal forms, with respect to the floor, a sealing line which runs parallel, but offset thereto. The sealing plane of the door bottom seal is identified by II in FIG. 2.

By means of the offset Y of said seals, a sealing gap arises laterally on both the lock side and the hinge side of the door, the sealing gap permitting the passage of sound, smoke, etc., and therefore reducing the sound insulation and sealing effect of the entire system consisting of door, frame and door bottom seal.

Figure 3:
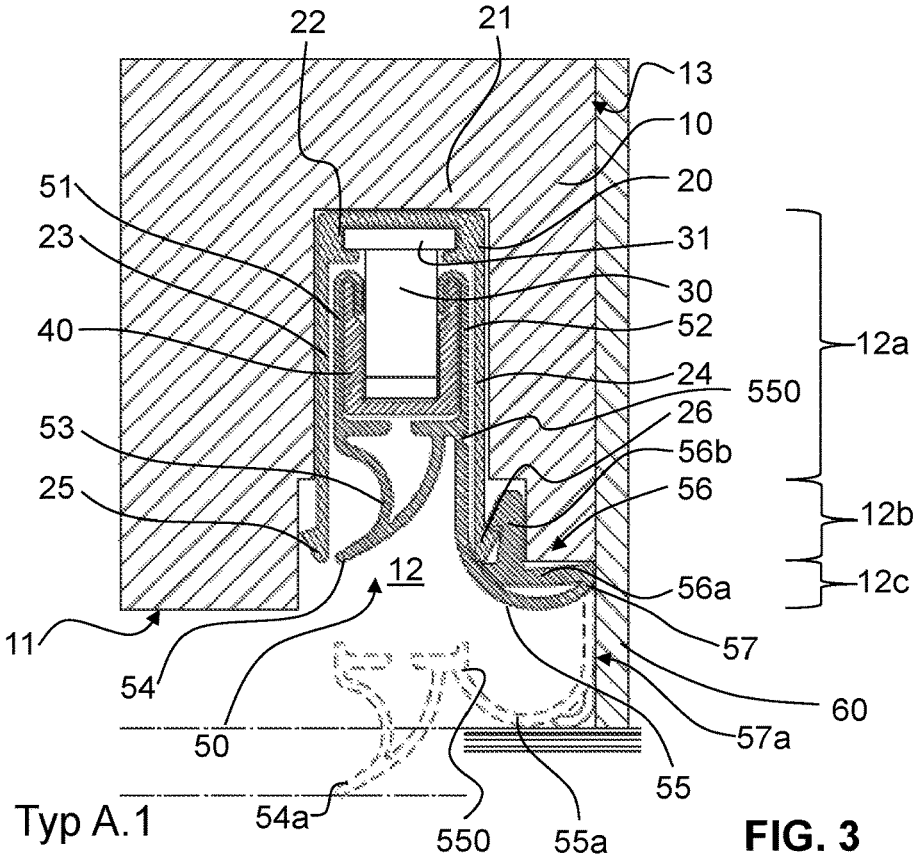
FIG. 3 shows a transversely sectioned side view taken along the lines III-III of a first embodiment of a door bottom seal according to the invention as illustrated in FIG. 9 in situ in a door.

FIG. 3 shows a first embodiment of the door bottom seal according to the invention in a fitted situation in a door. The door bottom seal is depicted in a raised state, and at the same time parts of the sealing element are also shown in a lowered state.

A door in which the door bottom seal is fitted has, in the lower edge 11 thereof, a groove 12 which is milled in the longitudinal direction of this edge. The groove 12 is designed in three stages: in a deep portion 12*a*, the groove is designed to be relatively narrow, a middle portion adjoining the deep portion in the direction of the door lower edge 11 is wider than said deep portion on both sides. In a lower portion 12*c* adjoining said middle portion 12*b* in turn in the direction of the lower edge of the door, the groove is widened in such a manner that it constitutes a step which extends to the frame as far as the stop surface and front door leaf surface 13 of the door. The door lower edge 11 is therefore arranged higher on the stop side than on the opposite side thereto.

In the portion 12*a*, a longitudinal profile 20 is anchored firmly in the groove over the entire length of the groove. This longitudinal profile serves as a fastening element for fastening the door bottom seal to the door. The longitudinal profile 20 is essentially designed as a U profile. In its base 21, said longitudinal profile has a groove rail 22 which serves for receiving a lowering mechanism unit 30. The lowering mechanism unit 30 can be pushed laterally into the groove rail 22 and can be arranged therein in a manner secured positively against dropping out. At the ends of the legs 23, 24, the longitudinal profile 20 in each case has a step 25, 26 which projects outward and is designed in cross section in the form of a hook.

The lowering mechanism unit 30 is fastened positively in the groove rail 22 of the fastening element 20 by means of a corresponding slide, here a portion 31 designed as a sliding block. The sliding block 31 can be designed as a step on both sides, which extends over the entire length of the lowering mechanism, alternatively, the sliding block 31 can also anchor the lowering mechanism unit 30 on the fastening element in only one, two or more regions which are distributed along the fastening element. The lowering mechanism unit itself is not explained in more detail here. It is connected at its lower edge opposite the sliding block 31 to a seal receiving element 40 and, by corresponding actuation, brings about a lowering of said seal receiving element 40 from the raised position shown in FIG. 3 into the lowered position partially shown for the sealing element in FIG. 3. The lowering mechanism unit acts here according to the principle known from the prior art, according to the invention, it can carry out in particular a vertical movement path and a horizontal movement path in the longitudinal direction of the door bottom seal.

The seal receiving element 40 is in turn designed as a U-shaped profile and is arranged about a horizontal plane in a mirror-inverted manner with respect to the fastening element 20, i.e. the legs of the fastening element 20 point downward whereas the legs of the seal receiving element point upward. The seal receiving element 40 is fixedly fastened to the lowering mechanism unit 30 and is moved upward or downward by the latter.

A sealing element 50 of the door bottom seal is fastened to the seal receiving element 40. This fastening of the sealing element 50 takes place by means of two vertically extending leg surfaces of the sealing element 50, which leg surfaces are turned over inward at their upper end and can thereby be turned over about the leg ends in a positive manner on the seal receiving element 40 and fastened. By this means, a fastening which is secured against vertical dropping out of the sealing element 50 but permits a horizontal displaceability in the longitudinal direction of the sealing element 50 is obtained.

The sealing element 50 furthermore has, in the region below the seal receiving element 40, an upwardly open profile chamber 53 which peters out to a point downward in a sealing lip running obliquely downward laterally. The sealing lip 54 forms a first sealing line 54*a* which, when the seal receiving element 40 is lowered, comes into contact with the floor and brings about a seal over the entire length of the door bottom seal.

It should basically be understood that the sealing element 50, as shown, can be fastened in the described manner to a seal receiving element 40 which, in turn, is fastened to the lowering mechanism unit 30. However, the invention also covers embodiments in which the seal receiving element is part of the lowering mechanism unit and the sealing element 50 is consequently fastened directly to the lowering mechanism unit 30.

In an extension of the right leg 52, which is located with respect to the door stop plane, of the sealing element, a sealing leg arc 55 is formed downward on the sealing element 50. A recess 550 is present between the sealing lip 54 and the sealing leg arc 55. The sealing leg arc 55 extends from the lower end of the leg 52 as far as an end, which points outward with respect to the door stop plane, of a fastening region 56 of the sealing element 50. The fastening region 56 preferably extends over the entire length of the door bottom seal and comprises a horizontal portion 56*a* and a snap hook portion 56*b* protruding upward from said horizontal portion 56*a*. The snap hook portion 56*b* can be fixed positively in the groove region 12*b* to the hook profile 26 at the end of that leg 23 of the fastening element which is located on the side of the door stop plane, and is thereby located in a manner fixed to the door.

The horizontal portion 56*a* extends beyond the snap hook portion into the plane of the door leaf surface 13 facing the door frame 60. The sealing leg arc is fastened as a single piece to the end of this portion extending beyond the snap hook section. The end of the extending portion 56*a* and that part of the sealing leg arc which is fastened thereto form a door frame sealing portion 57 which provides a sealing surface 57*a* against the door frame. When the sealing element is lowered, said sealing surface is placed and pressed onto the door frame or onto a seal fastened there, as a result of which secure sealing of the door bottom seal against the door frame is achieved.

When the seal receiving element 40 is lowered by means of the lowering mechanism unit, only the left end of the sealing leg arc 55, which end is fastened to the seal receiving element, is moved downward while the right end remains fixed to the right corner of the door lower edge and fixed in contact with the door frame. The sealing leg arc thereby executes a stroke movement which corresponds approximately to half of the displacement of the profile chamber 53. Said sealing leg arc rolls in the process at the right end on the door frame and forms a seal against the door frame. After striking on the floor, a second sealing line 55*a* is formed by the sealing leg arc 55, said second sealing line lying directly adjacent to the door stop plane and, upon further deformation and lowering, also being able to reach as far as said door stop plane. By means of such deformation, the sealing leg arc can also arch beyond the door leaf surface in the direction of the door frame and can thus bridge a gap and produce a seal with respect to the frame.

The profile chamber 53 of the sealing element 50 is designed to be open upward and thereby provides a high degree of elastic deformability of the sealing lip 54. By contrast, the sealing leg arc is designed in a wall thickness which provides a lower elastic deformability in contact with the floor, and therefore a greater sealing force is provided here, with the consequence of reliable sealing against a rectilinear sealing plane. The sealing lip 54 can also achieve reliable sealing in the first sealing line with respect to unevennesses in the sealing line.

Figure 4:
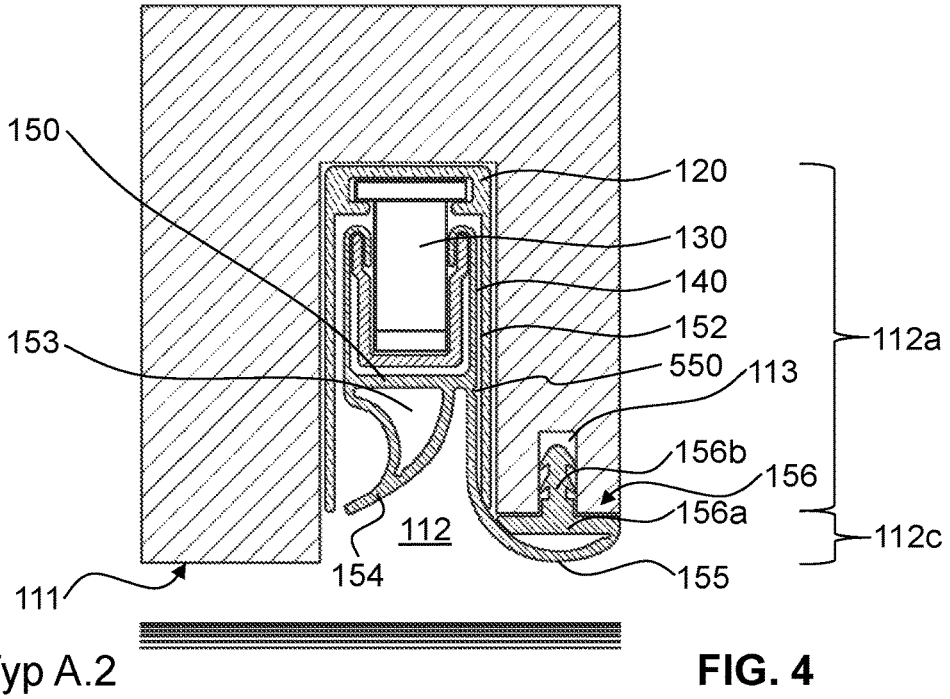
FIG. 4 shows a transversely sectioned side view taken along the lines IV-IV of a second embodiment of a door bottom seal according to the invention as illustrated in FIG. 10 in situ in a door.

FIG. 4 shows a second embodiment of the door bottom seal according to the invention. This second embodiment differs from the first embodiment in the following points:

A fastening element 120 is inserted into a groove 112 which has a deep portion 112*a* and an upper portion 112*c*, i.e. a middle portion is omitted in this embodiment. The fastening element 120 does not have any hook-shaped steps at the leg ends and is inserted fixedly directly into the deep portion 112*a* of the groove.

The fastening of the lowering mechanism unit 130 in the region of the base of the fastening element 120, of a seal receiving element 140 on the lowering mechanism unit 130 and of a sealing element 150 on the seal receiving element 140 are designed corresponding to the first embodiment according to FIG. 3.

In the second embodiment according to FIG. 4, a sealing hollow chamber profile portion 153 which likewise bears a sealing lip 154 pointing obliquely downward is formed. Said sealing hollow chamber portion 153 is of closed design and thereby has a lower degree of elasticity and exerts a higher contact pressure force for the second sealing line.

A sealing leg arc 155 extends in the same manner from the lower end of a leg arc 152 of the sealing element as far as that outer end of a fastening portion 156 which faces the door stop plane. The fastening portion 156 in turn has a horizontal base 156*a* in which, however, in contrast to the first embodiment, a profile portion 156*b* is formed centrally, said profile portion by means of corresponding barb profiles into a separate groove 113, which is arranged next to the groove 12, in the lower edge 111 of the door leaf.

Figure 5:
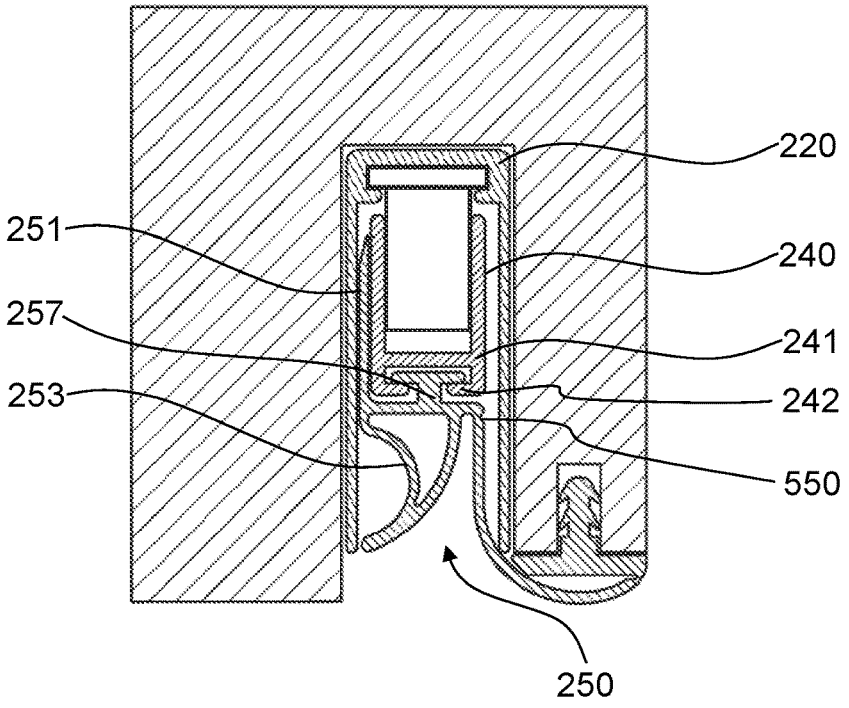
FIG. 5 shows a transversely sectioned side view taken along the lines V-V of a third embodiment of a door bottom seal according to the invention as illustrated in FIG. 11 in situ in a door.

FIG. 5 shows a third embodiment of the door bottom seal according to the invention which differs from the second embodiment according to FIG. 4 in the design of the fastening of the sealing element 250 to the seal receiving portion 240. The seal receiving element 240 is likewise designed as a U-shaped profile, but always has an outwardly facing groove rail 242 in the region of its base 241. A longitudinal structure which is formed on the sealing element 250 above the hollow chamber profile 253 and is T-shaped in cross section is introduced into said groove rail and ensures that the sealing element 250 is fastened positively to the seal receiving element 240.

Furthermore, the sealing element 250 of the third embodiment does not have any legs which point upward and are turned over at their end, as is provided in the two embodiments above for fastening the sealing element. Instead, an individual leg 251 is formed only on the side facing away from the stop side of the door, said leg not being turned over at its upper end, but rather ending with a bevel. This individual leg serves in order to produce a sealing effect between the seal receiving element 240 and the fastening element 220 and therefore to prevent bypassing of the sealing lines formed by the sealing element with the floor.

Figure 6:
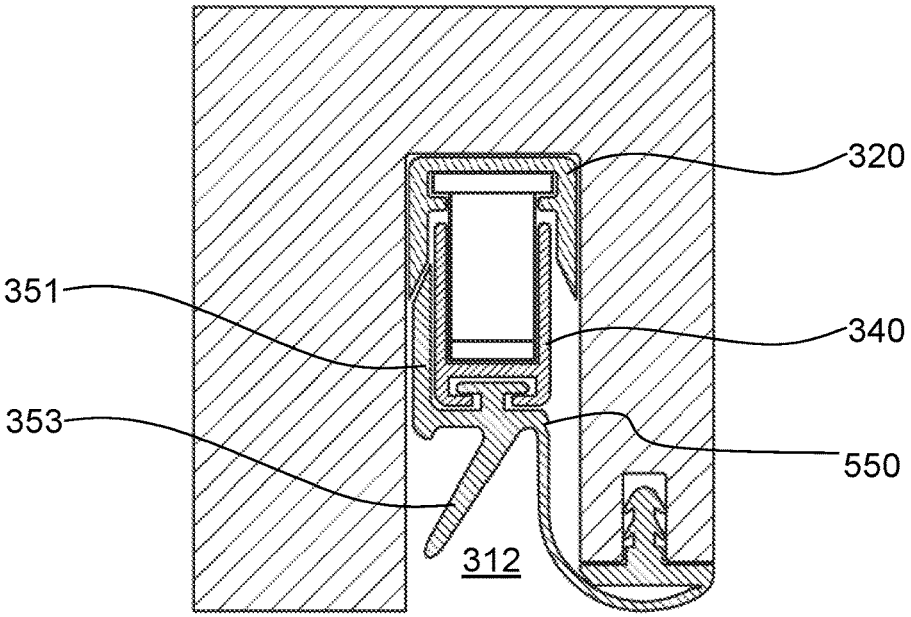
FIG. 6 shows a transversely sectioned side view taken along the lines VI-VI of a fourth embodiment of a door bottom seal according to the invention as illustrated in FIG. 12 in situ in a door.

FIG. 6 shows a fourth embodiment of the door bottom seal according to the invention which differs from the previously explained, third embodiment in two functional aspects. Firstly, the fastening element 320 of this fourth embodiment is designed with shorter legs, and therefore the sealing leg 351, which is formed on one side, of the sealing element 350 does not seal against the fastening element, but instead against the side wall of the groove 312 which is introduced into the lower edge of the door. In this embodiment, the side leg 351 is therefore formed with a greater wall thickness than in the previously explained, third embodiment.

As a second differentiating aspect, the fourth embodiment is not equipped with a hollow chamber profile and lip integrally formed thereon for forming the first sealing line. Instead, a sealing lip 353 which runs obliquely downward and forms the first sealing line at its lower end extends directly below the seal receiving element 340 from the t-shaped longitudinal portion, which serves for the positive anchoring of the sealing element.

It should basically be understood that the fastening element and the seal receiving element of the embodiments of the invention can be produced as an extruded profile, for example aluminum extruded profile, as a result of which high corrosion resistance and adequate strength can be provided. However, in order to reduce the production costs, it can also be provided according to the invention that the fastening element and/or the seal receiving element are provided from a beveled sheet profile made from aluminum, steel or plastic. The embodiments of FIGS. 7 and 8 show examples of door bottom seals of such a construction.

Figure 7:
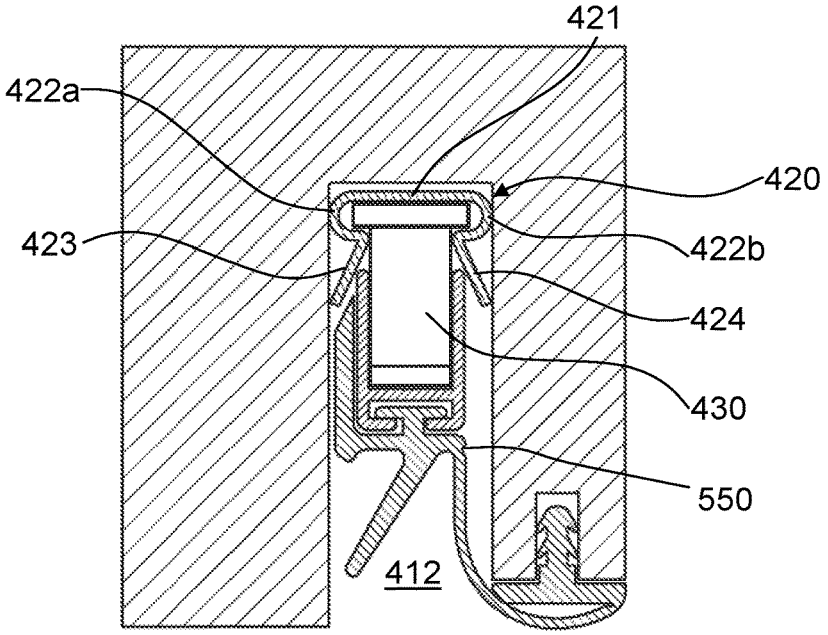
FIG. 7 shows a transversely sectioned side view taken along the lines VI-VI of a fifth embodiment of a door bottom seal according to the invention as illustrated in FIG. 12 in situ in a door.

FIG. 7 shows a fifth embodiment of the invention. This differs from the fourth embodiment in that the fastening element is not designed as an extruded profile, but instead as a sheet profile, for example as an aluminum or plastics profile or roll-shaped steel profile. The fastening element 420 has, in cross section, a bottom portion 421 which has end regions 422*a, b* which are bent laterally on both sides by approximately 180° in a radius and which in turn form a groove rail for receiving the lowering mechanism unit 430. Starting from the bent end portions, the fastening element is then provided on both sides with two legs 423, 424 which are beveled in an opposed manner with respect thereto and extend downward obliquely outward. Overall, the aluminum, plastics or steel profile serving as the fastening element 420 likewise has a U-shaped structure in cross section.

Figure 8:
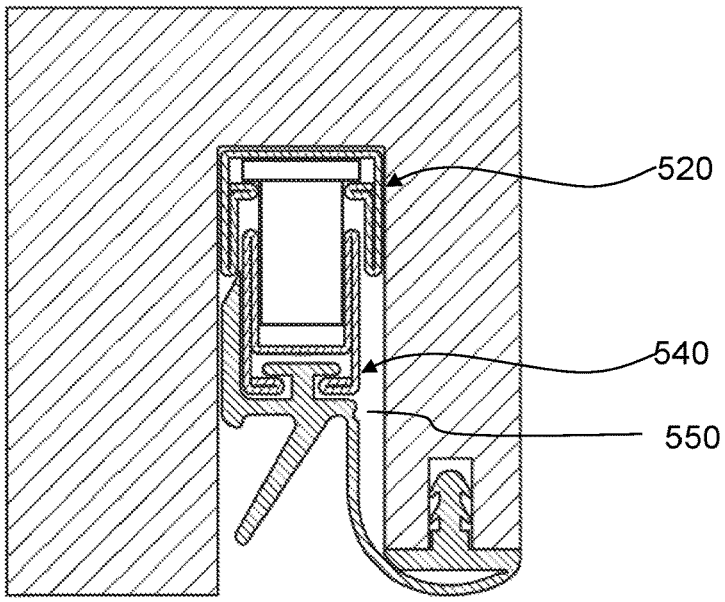
FIG. 8 shows a transversely sectioned side view taken along the lines VI-VI of a sixth embodiment of a door bottom seal according to the invention as illustrated in FIG. 12 in situ in a door.

In the sixth embodiment which is shown in FIG. 8, the fastening element is likewise designed as a roll-shaped aluminum, plastics or steel profile, wherein a profile 520 corresponding in cross section to the fastening element 320 is formed from a thin sheet portion by two 90° bevels formed in each case at the top in both corners, two 180° bevels formed at the ends of the legs, two inwardly directed 90° bevels and two 180° bevels formed in each case. The fastening element 520 according to FIG. 8 has the same properties functionally as the extruded profile 320 of the fourth embodiment according to FIG. 6.

In the case of the sixth embodiment, the seal receiving element 540 is likewise designed as an aluminum or plastics profile or roll-shaped steel profile. It is formed for this purpose by two 90° bevels formed laterally on the base, two 180° bevels at the end of the legs and two 90° bevels designed for formation with the groove rail for receiving the t-shaped longitudinal portion, with 180° bevels formed at the inwardly directed ends, and thereby replicates the seal receiving element 340 of the fourth embodiment.

Figure 9:
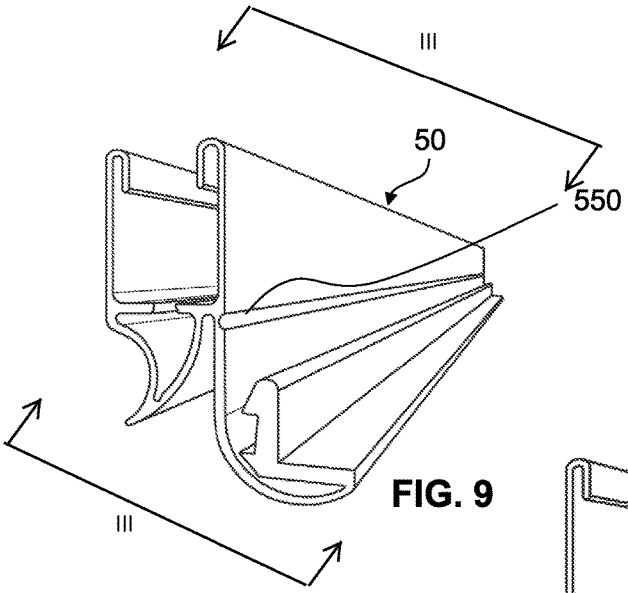
FIG. 9 shows a perspective view laterally and frontally of a sealing element of the first embodiment.
Figure 10:
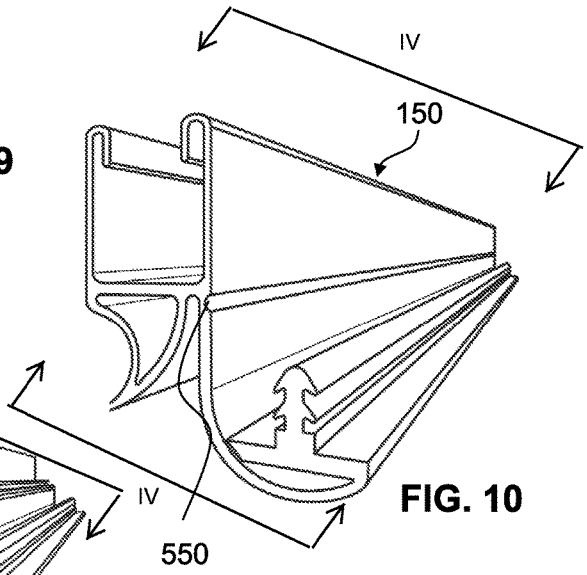
FIG. 10 shows a perspective view laterally and frontally of a sealing element of the second embodiment.
Figure 11:
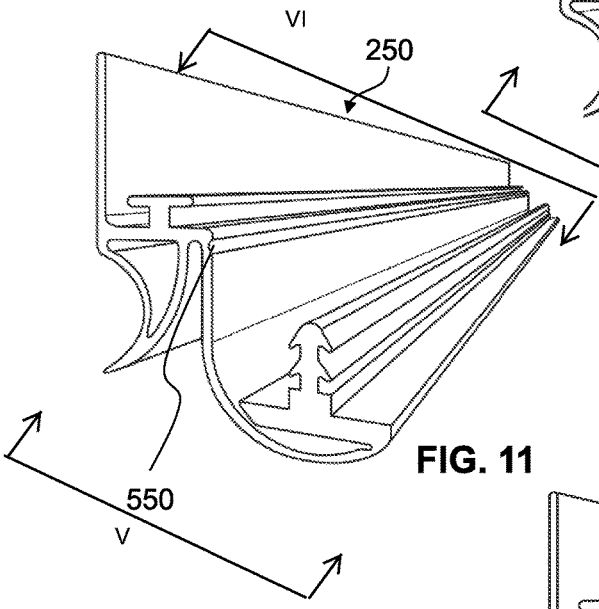
FIG. 11 shows a perspective view laterally and frontally of a sealing element of the third embodiment.
Figure 12:
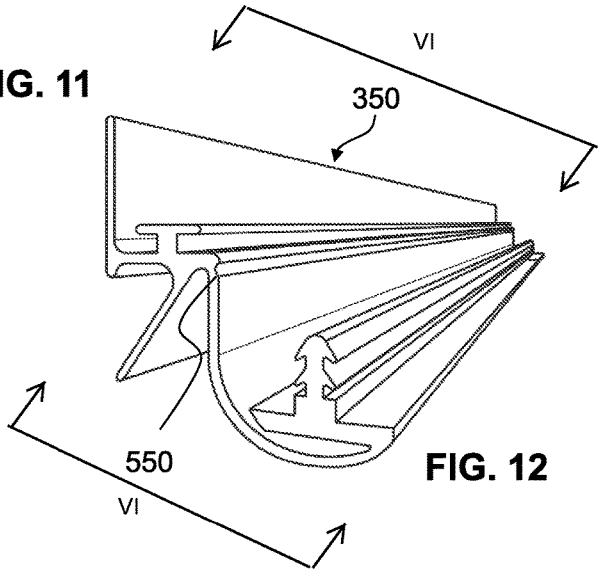
FIG. 12 shows a perspective view laterally and frontally of a sealing element of the fourth to sixth embodiment.

FIGS. 9-12 depict the sealing elements of the previously explained embodiments in a perspective view. FIG. 9 shows the sealing element 50 which is used in the first embodiment according to FIG. 3. FIG. 10 shows the sealing element 150 which is used in the second embodiment according to FIG. 4. FIG. 11 shows the sealing element 250 which is used in the third embodiment. FIG. 12 shows the sealing element 350 which is used in the fourth, fifth and sixth embodiment.

Figure 13:
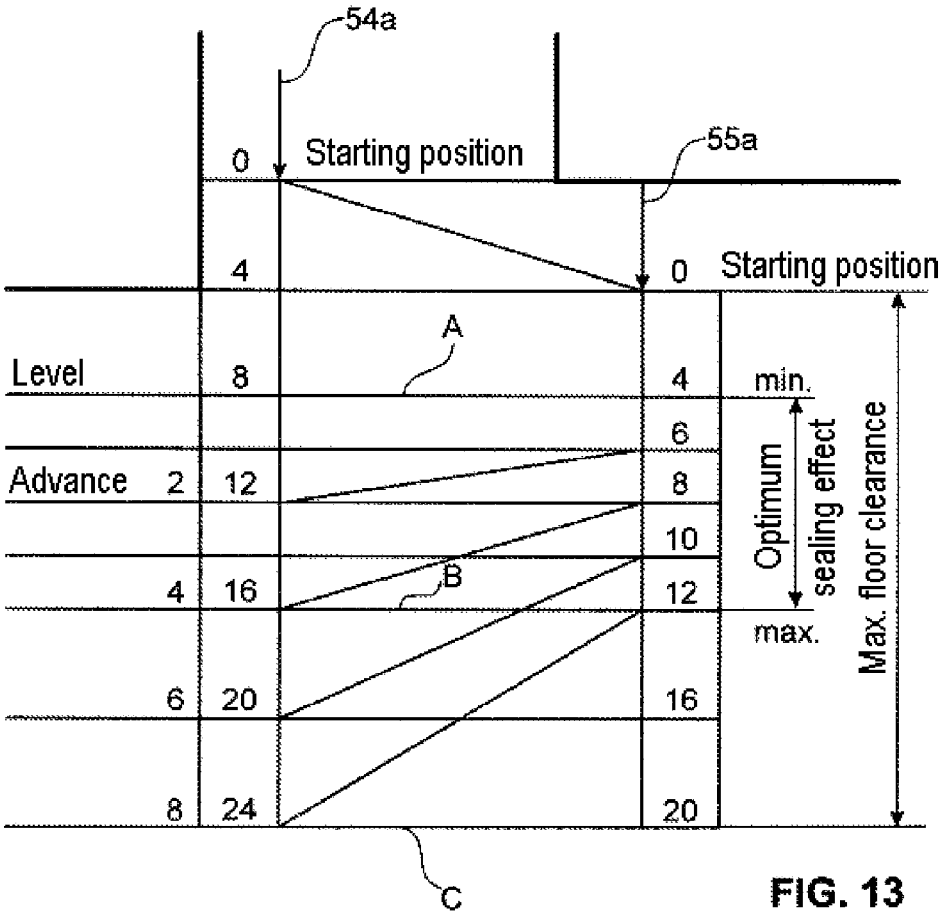
FIG. 13 shows a diagram which reproduces the lowering movement of the first and second sealing plane of the door bottom seal according to the invention.

FIG. 13 shows a diagram which explains an example of an embodiment of a door bottom seal of the design according to the invention in its lowering sequence of the two sealing lines. The first sealing plane, which corresponds to the sealing line 54*a* according to FIG. 3, lies in the raised position 4 millimeters above the position of the second sealing line, which corresponds to the sealing line 55*a* of FIG. 3. The planes defined by said sealing lines are offset parallel to each other and extend over the entire length of the door bottom seal.

Starting from this raised starting position, after a stroke of the lowering mechanism unit of 8 millimeters, a level is reached at A at which the two sealing lines are at the same height. Up to this level, the first sealing line has covered a distance, corresponding to the stroke of the lowering mechanism unit, of 8 millimeters and the second sealing line has covered half of the distance with respect thereto of 4 millimeters.

If the lowering mechanism unit is lowered further from this level position, an advance of the first sealing line with respect to the second sealing line occurs, i.e. the first sealing line lies lower than the second sealing line. Upon further lowering by 8 millimeters to an overall stroke of 16 millimeters at B, this difference is already 4 millimeters and, with lowering even further by 8 millimeters, is already 8 millimeters. In the example illustrated, the lowering mechanism unit can execute an overall stroke of 24 millimeters which leads to a distance of 24 millimeters of the first sealing line and a distance of 12 millimeters of the second sealing line at C.

In this configuration, a maximum floor clearance, i.e. a maximum distance between the door lower edge and the floor of 20 millimeters, can be bridged with the door bottom seal. However, at a floor clearance of more than 12 millimeters, the sealing effect is achieved only by the first sealing line 54*a*. The optimum sealing effect of the door bottom seal configured in such a manner is achieved at a floor clearance which lies between 4 and 12 millimeters. This is an installation region which is suitable in practice and can be adjusted without relatively great outlay, ensures reliable, free running of the door and achieves a sealing effect, which is considerably improved over the prior art, by the two sealing lines with differing contact pressure force and position.

The invention claimed is:

1. A door seal, comprising a fastening element for fastening to a door, a seal receiving element, a lowering device that mechanically couples the fastening element to the seal receiving element and which is configured to lower the seal receiving element relative to the fastening element from a raised position into a lowered position and conversely to raise the seal receiving element from the lowered position to the raised position, and a sealing element which is fastened to the seal receiving element and extends in a longitudinal direction, wherein the sealing element comprises a first sealing element portion which provides a first sealing line, wherein the first sealing element portion is lowered and raised together with the seal receiving element by the lowering device, wherein the sealing element comprises a second sealing element portion which provides a second sealing line wherein the second sealing line runs parallel to the first sealing line, wherein the second sealing element portion has a first side and a second side, wherein the first side is lowered and raised together with the seal receiving element by the lowering device, and the second side is fixed in the position in relation to the fastening element, wherein the sealing element comprises a recess, the recess defining a region of the sealing element being thinner than regions of the sealing element bordering on the recess, the recess being arranged on the first side of the second sealing element and the recess separating the second sealing element portion from the first sealing element portion, and wherein in the lowered state, the first and the second sealing line seal against a surface located outside the door seal.

2. The door seal as claimed in claim 1, wherein the second sealing element portion is formed by a sealing leg arc.

3. The door seal as claimed in claim 1, wherein the first sealing element portion is configured to be lowered and raised with a full lowering stroke of the lowering device, wherein the full lowering stroke defines a distance, and wherein, in the raised state, the second side of the second sealing element portion is mounted along the defined distance at a lower height than the first sealing element portion.

4. The door seal as claimed in claim 1, wherein the first sealing element portion is configured to be lowered and raised with a full lowering stroke of the lowering device, and wherein the second sealing element portion is configured to be lowered and raised by the lowering device with a fraction of the lowering stroke of the lowering device.

5. The door seal as claimed in claim 4, wherein the second sealing element portion is configured to be lowerable and raisable a distance that is equal to half of the lowering stroke of the lowering device.

6. The door seal as claimed in claim 1, wherein the second side of the second sealing element portion is arranged laterally transversely with respect to the longitudinal direction, offset to a fastening of the first sealing element portion.

7. The door seal as claimed in claim 1, wherein the first sealing element portion and the second sealing element portion are configured as a single piece.

8. The door seal as claimed in claim 7, wherein the sealing element is configured as a single piece.

9. The door seal as claimed in claim 1, wherein the sealing element is mounted in a freely displaceable manner in the longitudinal direction relative to the fastening element.

10. The door seal as claimed in claim 9, wherein the sealing element is mounted in a freely displaceable manner on the seal receiving element.

11. The door seal as claimed in claim 1, wherein the sealing element has a first fastening portion for fastening to the seal receiving element and wherein the sealing element has a second fastening portion for fastening the sealing element to the door or to the fastening element, wherein the second fastening portion is spaced apart from the first fastening portion.

12. The door seal as claimed in claim 11, wherein the second sealing line is arranged mechanically between the first and the second fastening portion.

13. The door seal as claimed in claim 11, wherein the first fastening portion is displaceable relative to the fastening element and the second fastening portion is configured to be positionally fixed to the door or to the fastening element.

14. The door seal as claimed in claim 1 wherein the sealing element has an entire length and wherein at least one of the fastening element,
the seal receiving element,
the first sealing element portion,
the second sealing element portion,
the first fastening portion, or
the second fastening portion
extend over the entire length of the sealing element.

15. The door seal as claimed in claim 1, wherein the first fastening portion extends parallel and over a same length as the second fastening portion.

16. The door seal as claimed in claim 1, wherein the second sealing line is formed on an arc portion which is arched convexly outward.

17. The door seal as claimed in claim 16, wherein the second sealing line has, at one arc end, a first fastening region for positionally fixed fastening of the sealing element to the door or to the fastening element, and, at another arc end, has a second fastening region for the vertically movable fastening relative to the fastening element.

18. The door seal as claimed in claim 1, wherein the sealing element has a first fastening region for positionally fixed fastening of the sealing element to the door, and a second fastening region for the vertically movable fastening relative to the fastening element, and a frame sealing portion of the sealing element extends from the second fastening region beyond the first fastening region for positioning at a door leaf surface and sealing against a door frame.

19. A door leaf with a door seal as claimed in claim 1, wherein the second sealing element portion reaches as far as a border of the lower edge of the door leaf.

20. The door leaf as claimed in claim 19, wherein the second sealing element portion is a frame sealing portion and extends into a plane of the door leaf surface facing the frame, or extends beyond said plane.

21. The door seal as claimed in claim 19, wherein the second sealing element portion reaches as far as the border of the lower edge of the door leaf such that the second sealing line is arranged adjacent to the border of the lower edge of the door leaf.

22. The door seal as claimed in claim 21, wherein the second sealing line is arranged at a distance of less than 10 mm from the border of the lower edge of the door leaf.

23. The door seal as claimed in claim 22, wherein the distance is less than 7.5 mm.

24. The door seal as claimed in claim 1, wherein the first sealing element portion extends parallel and over a same length as the second sealing element portion.

25. The door seal as claimed in claim 1, wherein the second sealing element portion is a sealing arc, wherein the sealing arc extends from a first arc end to a second arc end, and wherein the two arc ends are configured to be lowerable and raisable together with the seal receiving element.

26. A method of sealing an air gap between the door and a floor or a floor sill, comprising using the door seal according to claim 11, wherein the second fastening portion is fastened in a border region of a lower edge of the door or to the fastening element.

27. The method as claimed in claim 26 wherein the second sealing line of the door seal is formed on an arc portion which is arched convexly outward and, at one arc end, has a first fastening region for positionally fixed fastening of the sealing element to the door or to the fastening element, and, at another arc end, has a second fastening region for the vertically movable fastening relative to the fastening element, wherein a part of the second fastening portion runs in the border region of the lower edge of the door.

28. The method as claimed in claim 27, wherein the part of the second fastening portion runs in alignment with a door leaf surface of the door above the border region of the lower edge of the door.

* * * * *